US011841114B2

(12) United States Patent
Guo et al.

(10) Patent No.: US 11,841,114 B2
(45) Date of Patent: Dec. 12, 2023

(54) PLUGGABLE LAMP

(71) Applicant: CH LIGHTING TECHNOLOGY CO., LTD., Shaoxing (CN)

(72) Inventors: Jiejiang Guo, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 18/054,913

(22) Filed: Nov. 14, 2022

(65) Prior Publication Data

US 2023/0071769 A1 Mar. 9, 2023

Related U.S. Application Data

(63) Continuation of application No. PCT/CN2021/112364, filed on Aug. 12, 2021.

(30) Foreign Application Priority Data

| | | |
|---|---|---|
| Mar. 30, 2021 | (CN) | 202120648398.5 |
| Mar. 30, 2021 | (CN) | 202120648846.2 |
| Mar. 30, 2021 | (CN) | 202120649527.2 |
| Mar. 30, 2021 | (CN) | 202120650506.1 |
| Apr. 29, 2021 | (CN) | 202120919818.9 |
| Apr. 29, 2021 | (CN) | 202120923911.7 |
| May 28, 2021 | (CN) | 202121182914.6 |
| May 28, 2021 | (CN) | 202121186143.8 |

(51) Int. Cl.

| | |
|---|---|
| ***F21K 9/23*** | (2016.01) |
| ***F21V 29/50*** | (2015.01) |
| ***F21S 4/28*** | (2016.01) |
| ***F21V 23/06*** | (2006.01) |

(52) U.S. Cl.

CPC ..... *F21K 9/23* (2016.08); *F21S 4/28* (2016.01); *F21V 23/06* (2013.01); *F21V 29/50* (2015.01)

(58) Field of Classification Search

CPC .. F21V 23/06; F21V 29/50; F21S 4/28; F21K 9/23

See application file for complete search history.

(56) References Cited

FOREIGN PATENT DOCUMENTS

| | | | |
|---|---|---|---|
| CN | 103322444 A | | 9/2013 |
| CN | 204187310 U | * | 3/2015 |
| CN | 204187310 U | | 3/2015 |

(Continued)

*Primary Examiner* — Anabel Ton

(57) ABSTRACT

A pluggable lamp includes a light-emitting tube body, a lamp head and a lamp seat provided at two ends of the light-emitting tube body. The light-emitting tube body includes a heat-dissipating member, a light-emitting plate and a light-transmitting cover. A first mounting groove is opened on one side of the heat-dissipating member. The light-emitting plate has a bottom side overlapped against a groove bottom of the first mounting groove. At least one lamp head pressing element is provided on one side of the lamp head facing the light-emitting tube body, and at least one lamp seat pressing element is provided on one side of the lamp seat facing the light-emitting tube body. The lamp head pressing element and the lamp seat pressing element abut against the top side of the light-emitting plate adjacent the lamp head and the top side of the light-emitting plate adjacent the lamp seat, respectively.

19 Claims, 11 Drawing Sheets

(56) References Cited

FOREIGN PATENT DOCUMENTS

| | | | | |
|---|---|---|---|---|
| CN | 206191311 | U | * | 5/2017 |
| CN | 206191311 | U | | 5/2017 |
| CN | 212617684 | U | | 2/2021 |

* cited by examiner

PLUGGABLE LAMP

CROSS REFERENCE TO RELATED APPLICATION

The present application is a Continuation Application of PCT Application No. PCT/CN2021/112364, filed on Aug. 12, 2021, which claims the priorities of Chinese Utility Model Application No. 202120648398.5, filed on Mar. 30, 2021, Chinese Utility Model Application No. 202120648846.1, filed on Mar. 30, 2021, Chinese Utility Model Application No. 202120649527.2, filed on Mar. 30, 2021, Chinese Utility Model Application No. 202120650506.2, filed on Mar. 30, 2021, Chinese Utility Model Application No. 202120919818.9, filed on Apr. 29, 2021, Chinese Utility Model Application No. 202120923911.7, filed on Apr. 29, 2021, Chinese Utility Model Application No. 202121182914.6, filed on May 28, 2021, and Chinese Utility Model Application No. 202121186143.8, filed on May 28, 2021, the entire contents of which are hereby incorporated by reference.

TECHNICAL FIELD

The present disclosure relates to an LED lamp, in particular to an LED pluggable lamp.

BACKGROUND

The known pluggable lamp generally includes a lamp head, a lamp seat and a light-emitting tube body. The light-emitting tube body includes a heat-dissipating member and a light-transmitting cover. The heat-dissipating member is provided with a light-emitting plate at the side opposite to the light-transmitting cover. The light-emitting plate consists of a substrate and LED on the substrate. In order to fix the light-emitting plate on the heat-dissipating member, the side of the heat-dissipating member opposite to the light-transmitting cover is provide with a mounting groove, and the light-emitting plate is fixed in the mounting groove by means of fastener or adhesive. However, the installation and replacement of the light-emitting plate are inconvenient.

SUMMARY OF THE INVENTION

Technical Problem

The invention provides a pluggable lamp, which solves the problem of inconvenient installation and replacement of the light-emitting plate of the conventional pluggable lamp.

Technical Solution

A pluggable lamp includes a light-emitting tube body, and a lamp head and a lamp seat respectively provided at two ends of the light-emitting tube body; the light-emitting tube body includes a heat-dissipating member, and a light-emitting plate and a light-transmitting cover provided on the heat-dissipating member, and a first mounting groove for mounting the light-emitting plate is opened on one side of the heat-dissipating member;

The light-emitting plate has opposite top and bottom sides, with the bottom side overlapped against a groove bottom of the first mounting groove, wherein one side of the light-emitting plate adjacent the lamp head is defined as a first end, and the other side of the light-emitting plate adjacent the lamp seat is defined as a second end;

At least one lamp head pressing element is provided on one side of the lamp head facing the light-emitting tube body;

At least one lamp seat pressing element is provided on one side of the lamp seat facing the light-emitting tube body;

The lamp head pressing element and the lamp seat pressing element abut against the top side at the first end and the top side at the second end, respectively, so as to fix the light-emitting plate within the first mounting groove.

Optionally, the lamp seat pressing element is a triangular pressing element.

Optionally, there are two lamp head pressing elements and two lamp seat pressing elements, which are arranged opposite to each other at the lamp head and the lamp seat, respectively.

Optionally, an LED light array is arranged on the light-emitting plate, and the LED light array includes a plurality of LED light units.

Optionally, the lamp head pressing element is square, and the contact area between the lamp head pressing element and the light-emitting plate is greater than or equal to the area of the LED light unit.

Optionally, the heat-dissipating member is tubular, and comprises a top plate provided with the first mounting groove and a heat-dissipating protrusion opposite to the first mounting groove, and wherein the heat-dissipating protrusion has a U-shaped cross section.

Optionally, the heat-dissipating member further comprises heat-dissipating fins disposed on the heat-dissipating protrusion.

Optionally, the lamp head is provided with a positioning rib at one side facing the light-emitting tube body and inserted into the heat-dissipating protrusion.

Optionally, the positioning rib includes a first positioning rib extending in a vertical direction and a second positioning rib extending in a horizontal direction.

Optionally, there are two first positioning ribs which are inserted into the heat-dissipating protrusion to abut against the two opposite side walls thereof, and there are two second positioning ribs which are inserted into the heat-dissipating protrusion to abut against the bottom thereof.

Optionally, the light-transmitting cover is an arc-shaped light-transmitting cover which is installed on the heat-dissipating member and completely covers the light-emitting plate.

Optionally, the lamp seat comprises an end plate and an annular side wall distributed along an edge of the end plate, with the end plate and the annular side wall enclosed a receiving groove opened toward the light-emitting tube body, and the end plate is provided with a first positioning step and a second positioning step adjacent to the edge of the end plate, and the first positioning step and the second positioning step are respectively engaged with the heat-dissipating protrusion of the heat-dissipating member and the light-transmitting cover.

Optionally, the first positioning step and the second positioning step have heights smaller than a depth of the receiving groove along a length direction of the light-emitting tube body.

Optionally, the heights of the first positioning step and the second positioning step are ½ of the depth of the receiving groove along the length direction of the light-emitting tube body.

Optionally, the first positioning step and the second positioning step are symmetrically arranged, with lengths extending in the circumferential direction of the lamp seat being ⅛ to ¼ of the circumference of the lamp seat, respectively.

Optionally, the lamp seat comprises a lamp seat end cap and an outer lamp seat cover connected with the lamp seat end cap, and one side of the lamp seat end cap facing the light-emitting tube body is connected with a dimmer switch which is electrically connected to the light-emitting tube body to adjust light colors thereof.

Optionally, a first window is opened in the lamp seat end cap, and a second window is opened in the outer lamp seat cover at a position corresponding to the first window of the lamp seat end cap, and wherein the dimmer switch is provided with a dimmer button which is exposed within the first window and the second window.

Optionally, the dimmer button does not exceed the top side of the outer lamp seat cover.

Optionally, the lamp seat end cap is provided with an outer frame surrounding the first window at one side facing the light-emitting tube body, and the dimmer switch is at least partially disposed within the outer frame and against the lamp seat end cap.

Optionally, the dimmer switch comprises a mounting seat and a dimmer switch body disposed on the mounting seat, the dimmer button is disposed on the dimmer switch body, and the mounting seat is connected with the lamp seat end cap through a connector.

Optionally, the outer frame is square, and the dimmer switch body is arranged within the outer frame and abuts against the lamp seat end cap.

Optionally, the height of the outer frame is ½ to ¼ of the height of the dimmer switch body.

Optionally, the dimmer switch is provided with a first mounting hole, and the lamp seat end cap is provided with a second mounting hole at a position corresponding to the first mounting hole, and wherein the dimmer switch is arranged on the lamp seat end cap by a connector passing through the first mounting hole and the second mounting hole.

Optionally, the outer lamp seat cover is provided with a hook for connecting with the lamp seat end cap at one side facing the lamp seat end cap, and the lamp seat end cap is provided with a first mounting opening at a position corresponding to the hook for mounting the hook.

Optionally, the hook comprises a hook body and a hook head connected with each other, and the hook body is connected to the outer lamp seat cover and configured as an elastic member.

Optionally, the hook head is provided with a guide slope for guiding the hook into the first mounting opening.

Optionally, the lamp head comprises a lamp head body, a lamp head end cap and a lamp fixing plate connected in sequence, and the lamp fixing plate is fixedly connected with the light-emitting tube body;

A mounting window is opened in a top side wall of the lamp head end cap, an internal gear ring is arranged in the lamp head end cap and surrounding the mounting window of the lamp head, and a rotation plate is arranged on the internal gear ring, wherein the rotation plate is rotatably connected with the internal gear ring, the lamp fixing plate is provided with a connector which is connected with the rotation plate through the mounting window, and the rotation plate is configured to be driven by the lamp fixing plate so as to rotate along the internal gear ring.

Optionally, the connector is configured as a connecting rod extending from the lamp fixing plate to the rotation plate, the rotation plate is provided with a mounting hole, and the connecting rod is inserted into the mounting hole through the mounting window to connect the lamp fixing plate and the rotation plate.

Optionally, the rotation plate comprises a positioning tooth meshing with the internal gear ring.

Optionally, the rotation plate comprises a limiting plate extending in a radial direction, and at least one stopper is arranged on a sidewall of the lamp head end cap.

Optionally, the stopper comprises a first block and a second block arranged on the side wall of the lamp head end cap, and the distance between the two blocks in the circumferential direction of the lamp head end cap is 0.2-0.3 of the circumference of the lamp head end cap.

Optionally, an inner side surface of the lamp head end cap facing the rotation plate is provided with at least one plastic protrusion, and the plastic protrusion abuts against the rotation plate.

Optionally, there are four plastic protrusions arranged in the circumferential direction of the lamp head end cap in turn.

Optionally, at least one second mounting opening is opened on a side wall of the lamp head body, and at least one elastic hook is arranged on an inner side wall of the lamp head end cap, and wherein the elastic hook extends into the second mounting opening to connect the lamp head body and the lamp head end cap.

Optionally, one of the at least one second mounting opening is provided with a positioning protrusion, and one of the at least one elastic hook is provided with a positioning groove matching with the positioning protrusion.

Optionally, the elastic hook is provided with a guide slope.

Optionally, a limiting groove is defined in the inner face of the lamp head end cap, and the limiting groove is abutted with the lamp head body extending into the lamp head end cap.

Optionally, there are four second mounting openings which are arranged in sequence along the circumferential direction of the lamp head body.

Optionally, the heat-dissipating member is provided with second mounting grooves respectively located at two sides of the first mounting groove, with a positioning flange provided on an inner wall of the second mounting groove, and the light-transmitting cover is provided with two hooked edges circumferentially opposite to each other, and the hooked edges respectively extend into the respective second mounting grooves and abut against the respective positioning flanges through elastic force.

Optionally, the hooked edge extends axially and comprises an inward extension portion and an outward extension portion, with a positioning portion bent between the inward extension portion and the outward extension portion and engaged with the positioning flange.

Optionally, the included angle between the plane where the inner extension portion is located and the plane where the light-emitting plate is located ranges from 45° to 75°.

Advantages

The light-emitting plate of the invention is fixed on the heat-dissipating member by the pressing elements at the lamp head and the lamp seat, which facilitates the assembly and replacement of the light-emitting plate, and the light-emitting plate is always attached to the heat-dissipating member and has high heat transmitting efficiency.

DESCRIPTION OF THE EMBODIMENTS

In the following, technical solutions according to the embodiments of the present disclosure will be described clearly and completely in conjunction with the drawings according to the embodiments of the present disclosure. Apparently, the embodiments described here are only part of the embodiments of the present disclosure, but not all of the embodiments. Based on the embodiments disclosed in this disclosure, all other embodiments obtained by those skilled in the art without making creative effort fall into the scope of the invention.

It should be noted that when a component is said to be "connected" to another component, it can be connected directly to another component or indirectly to another component via a further component. When a component is considered to be "provided" on another component, it can be provided directly on another component or indirectly on another component via a further component.

Unless otherwise defined, all technical and scientific terms used herein have the same meanings as those commonly understood by those skilled in the art. The terms used herein in the specification of this disclosure are for the purpose of describing specific embodiments only, but not intended to limit the invention. As used herein, the term "and/or" includes any one or any combinations selected from the listed items.

Figure 1:
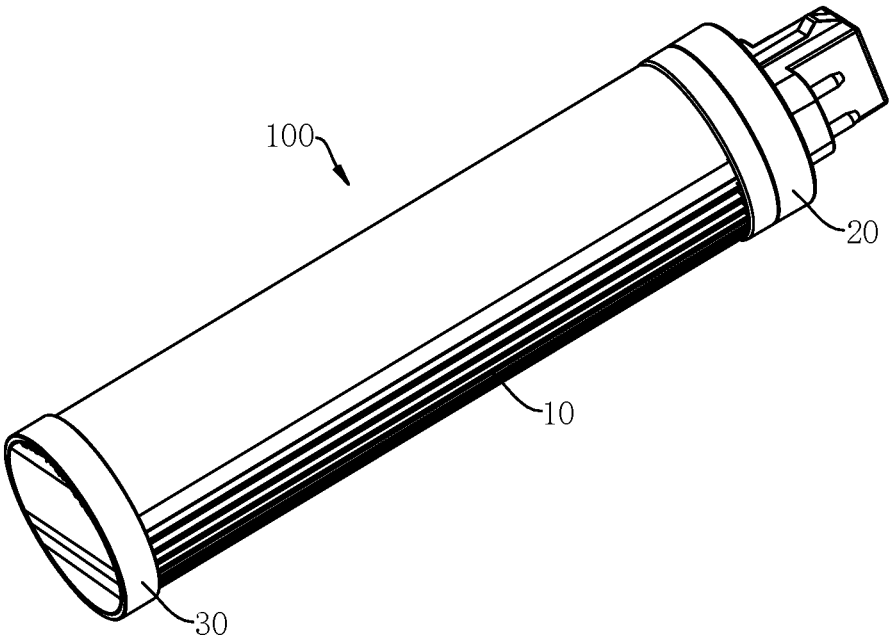
FIG. 1 is a schematic perspective view of a pluggable lamp according to an embodiment of the present disclosure.
Figure 2:
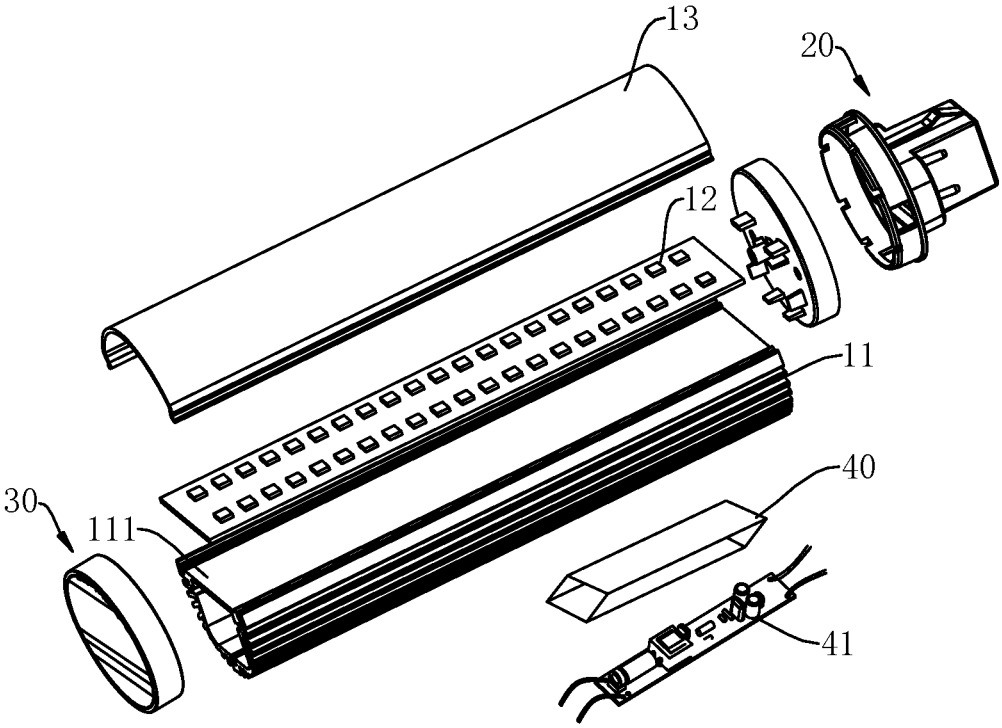
FIG. 2 is an exploded view of the pluggable lamp of FIG. 1.

Referring to FIGS. 1 and 2, an embodiment of the present disclosure provides a pluggable lamp 100, including a light-emitting tube body 10, a lamp head 20, and a lamp seat 30, which are detachably connected with one another. The lamp head 20 and the lamp seat 30 are installed at two ends of the light-emitting tube body 10, respectively.

As shown in FIG. 2, the light-emitting tube body 10 includes a heat-dissipating member 11, a light-emitting plate 12 and a light-transmitting cover 13. The light-emitting plate 12 and the light-transmitting cover 13 are installed above the heat-dissipating member 11. The heat-dissipating member 11 is provided with a first mounting groove 111 in one side thereof facing the light-transmitting cover 13 for receiving the light-emitting plate 12. The light from the light-emitting plate 12 can pass through the light-transmitting cover 13 for illumination or rendering a lighting atmosphere, and the heat generated by the light-emitting plate 12 is transmitted to the outside of the pluggable lamp 100 through the heat-dissipating member 11.

In one embodiment, as shown in FIGS. 1 and 2, the light-transmitting cover 13 is arc-shaped and mounted on the heat-dissipating member 11 so that the light-emitting plate 12 is completely covered by the light-transmitting cover 13. The light-transmitting cover 13 protects the light-emitting plate 12, and in turn, the light-emitting plate 12 emits light through the light-transmitting cover 13. The light-transmitting cover 13 can be configured as, for example, a PC device. The light-transmitting cover 13 is fitted to the heat-dissipating member 11 so as to form a cylindrical shape as a whole.

Figure 3:
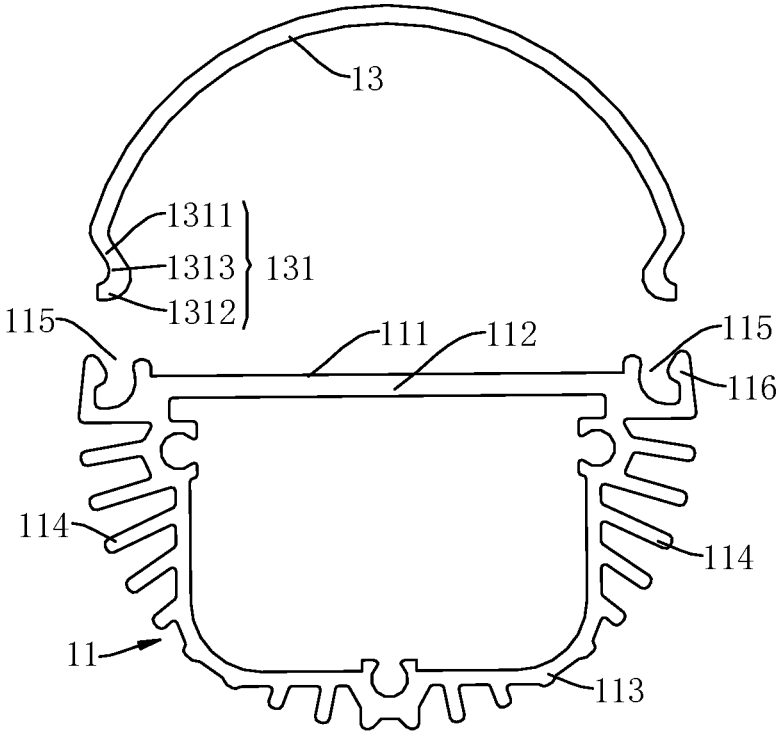
FIG. 3 is a schematic view of a heat-dissipating member and a light-transmitting cover of FIG. 2 in a separated state.
Figure 4:
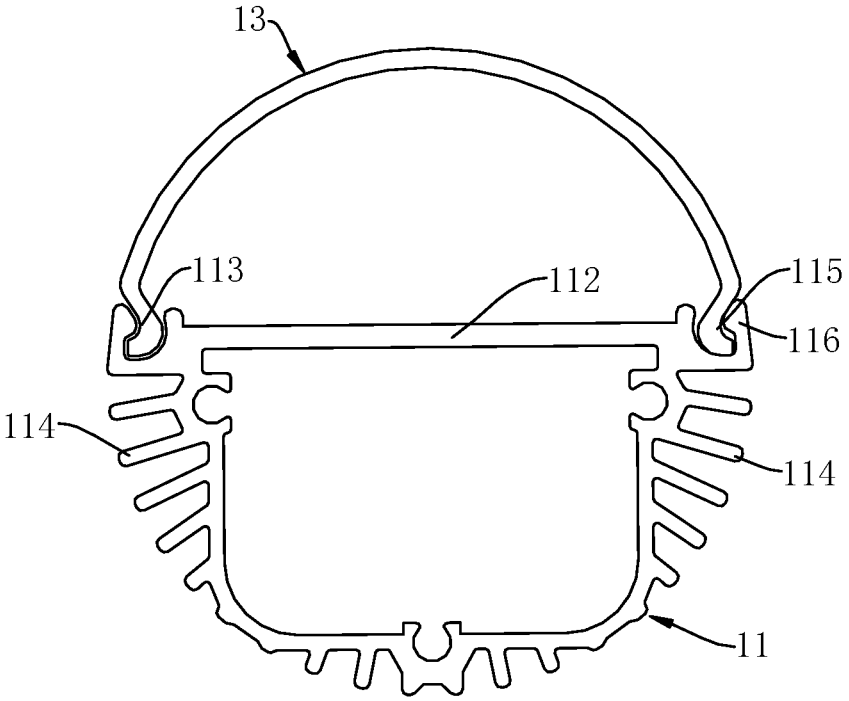
FIG. 4 is a schematic view of the heat-dissipating member and the light-transmitting cover of FIG. 2 in an assembled state.

As shown in FIGS. 3-4, two sides of the heat-dissipating member 11 are provided with second mounting grooves 115, respectively. The second mounting grooves 115 are provided in pairs. Edges of the light-transmitting cover 13 on two sides thereof are inserted into the second mounting grooves 115 for connection. The edges on two sides of the light-transmitting cover 13 can be crimped inwardly. Alternatively, the edges on two sides of the light-transmitting cover 13 can be crimped outwardly.

In the present embodiment, the light-transmitting cover 13 is provided with two hooked edges 131 that are opposite to each other circumferentially. The hooked edges 131 extend into the second mounting grooves 115, respectively, and abut against the respective positioning flanges 116 through elastic force. The hooked edges 131 are located at two sides of the light-transmitting cover 13, and engage with the second mounting grooves 115 at two sides of the heat-dissipating member 11. The hooked edges 131 being opposite to each other means that the two hooked edges 131 extend in opposite directions and outwardly. When the hooked edges 131 are installed into the second mounting grooves 115 under an external force, the hooked edges 131 are deformed and generate elastic force. After being installed in place, the hooked edges 131 presses the second mounting grooves 115 under restoring force and abut against the positioning flanges 116 so that the light-transmitting cover 13 would not easily escape from the second mounting grooves 115.

Specifically, the second mounting groove 115 is opened toward the light-transmitting cover 13, so that the hooked edge 131 can extend into the second mounting groove 115 from top to bottom easily. The second mounting groove 115 extends in the axial direction of the light-transmitting cover 13 so as to provide a long engaging length for stable assembly.

More specifically, as shown in FIG. 3, the hooked edge 131 extends in the axial direction, and includes an inward extension portion 1311 and an outward extension portion 1312, with a positioning portion 1313 bent between the inward extension portion 1311 and the outward extension portion 1312, which is engaged with the positioning flange 116. The hooked edge 131 generally extends from the inward extension portion 1311 via the positioning portion 1313 to the outward extension portion 1312, and accordingly, the second mounting groove 115 has a complementary shape.

Further, the angle between the plane where the inward extension portion 1311 is located and the plane where the light-emitting plate 12 is located ranges from 45 degrees to 75 degrees, so that the outward extension portion 1312 can enter into the second mounting groove 115 smoothly, and sufficient elastic force can be ensured to prevent the hooked edge 131 from escaping.

Figure 5:
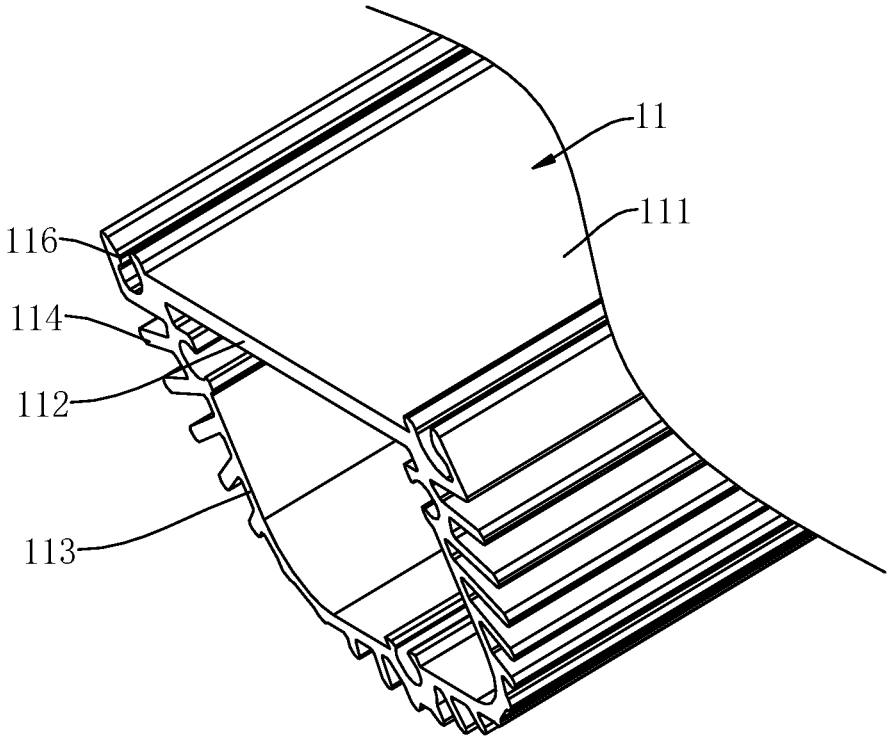
FIG. 5 is a partial schematic view of the heat-dissipating member of FIG. 2.

In one embodiment, as shown in FIGS. 3-5, the heat-dissipating member 11 is substantially tubular, and includes a top plate 112 and a heat-dissipating protrusion 113. The tubular heat-dissipating member 11 is enclosed by the top plate 112 and the heat-dissipating protrusion 113. The top plate 112 is provided with the first mounting groove 111 for mounting the light-emitting plate 12, and two sides of the top plate 112 are provided with the second mounting grooves 115. The heat-dissipating protrusion 113 faces away from the first mounting groove 111, and a cross section of the heat-dissipating protrusion 113 is substantially U-shaped. The top plate 112 and the heat-dissipating protrusion 113 enclose a space for supporting requirements and forming the tubular pluggable lamp 100, as well as for heat dissipating.

Further, the heat-dissipating member 11 further includes heat-dissipating fins 114 disposed on the heat-dissipating protrusion 113. The heat-dissipating fins 114 are arranged in the circumferential direction of the heat-dissipating protrusion 113 for increasing the heat-dissipating area. The heat-dissipating fins 114 extend outward from the heat-dissipating protrusions 113. The extension lengths of the heat-dissipating fins 114 can be set as required, depending on the profile of the pluggable lamp 100.

Figure 6:
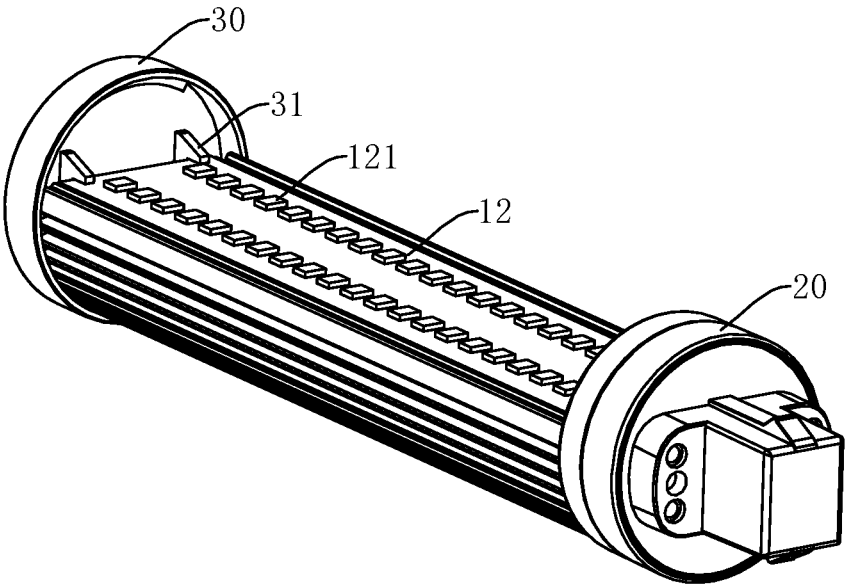
FIG. 6 is a schematic view of the pluggable lamp of FIG. 2 without showing the light-transmitting cover.
Figure 8:
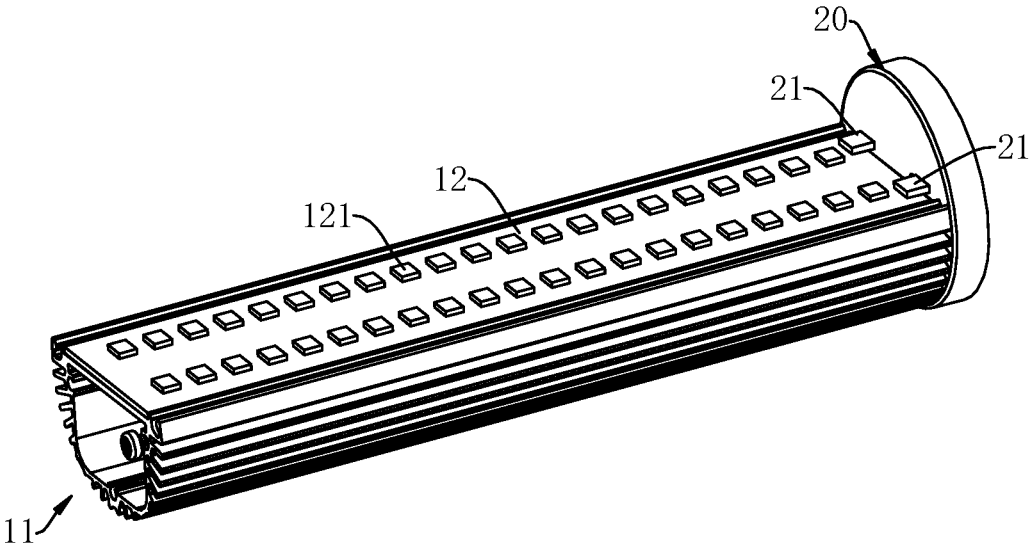
FIG. 8 is a schematic view of a lamp head and a light-emitting tube body of FIG. 3 in an assembled state.

In one embodiment, as shown in FIGS. 2, 6 and 8, an LED light array including a plurality of LED light units 121 is disposed on the light-emitting plate 12. The LED light array can be arranged in, for example, 1×20, 2×21, 4×15, etc.

As shown in FIGS. 6 and 8, the light-emitting plate 12 has opposite top and bottom sides, with the bottom side superposed and abutted against the bottom of the first mounting groove 111. The side of the light-emitting plate 12 adjacent the lamp head 20 is defined as a first end, and the other side adjacent the lamp seat 30 is defined as a second end.

Figure 7:
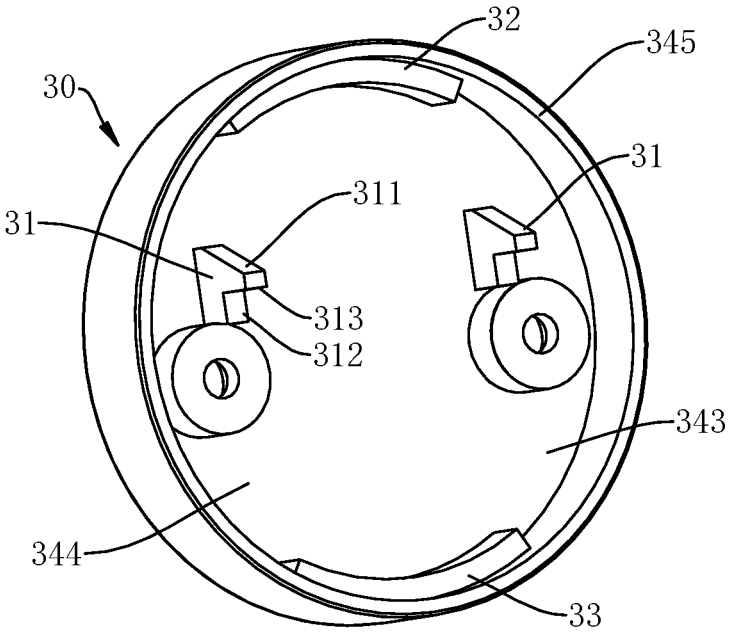
FIG. 7 is a schematic view of the lamp seat of FIG. 2.
Figure 9:
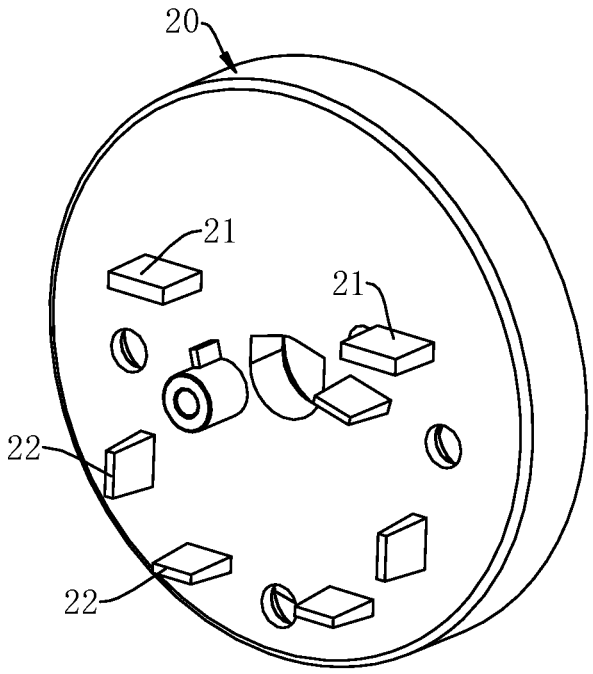
FIG. 9 is a schematic view of the lamp head of FIG. 2.
Figure 10:
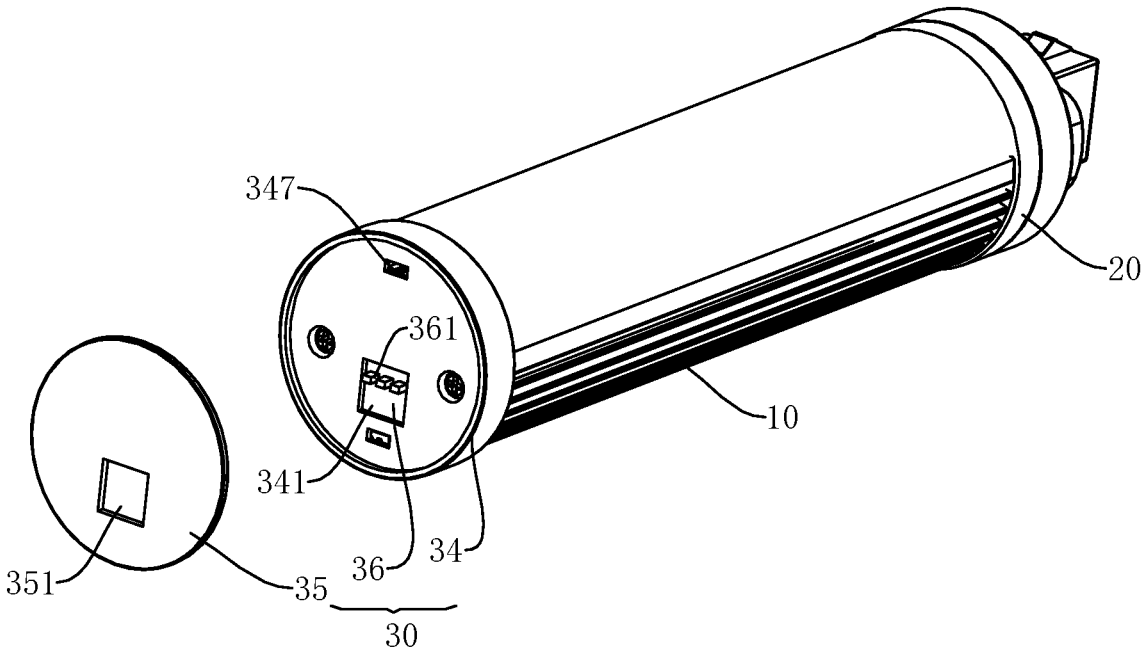
FIG. 10 is a schematic view of a pluggable lamp according to another embodiment of the present disclosure.

As shown in FIGS. 6 and 7, the lamp head 20 is provided with at least one lamp head pressing element 21 on one side of the lamp head 20 facing the light-emitting tube body 10. As shown in FIGS. 8 and 9, the lamp seat 30 is provided with at least one lamp seat pressing element 31 on one side of the lamp seat 30 facing the light-emitting tube body 10. The number of the at least one lamp head pressing element 21 and the least one lamp seat pressing element 31 can be 1, 2, 3, 4, etc.

The lamp head pressing element 21 and the lamp seat pressing element 31 respectively abut against the top side of the first end of the lamp head 20 and the top side of the second end of the lamp seat 30 of the light-emitting plate 12 to fix the light-emitting plate 12 in the first mounting groove 111, which apply force towards the bottom of the first mounting groove 111, or at least restrict the light-emitting plate 12 from moving away from the groove bottom.

In this embodiment, the lamp head pressing element 21 and the lamp seat pressing element 31 can effectively limit and hold the light-emitting plate 12, preventing the light-emitting plate 12 from displacement, facilitating installation and disassembly, and omitting the step of gluing or fasteners.

In one embodiment, as shown in FIG. 7, the lamp seat pressing element 31 is configured as a triangular pressing element, which has a snapping portion 311. The snapping portion 311 has a triangular shape for improving the holding force. The triangular pressing element has a supporting face 312 for abutting the end face of the light-emitting plate 12, and a snapping surface 313 provided on the snapping portion 311 for abutting the top face of the light-emitting plate 12.

In another embodiment, the lamp head pressing element 21 is square. The contact area between the lamp head pressing element 21 and the light-emitting plate 12 is larger than or equal to the area of the LED light unit 121. The contact area of the lamp head pressing element 21 should not be too small. A too small contact area of the lamp head pressing element 21 cannot prevent displacement very well, while a too large contact area of the lamp head pressing element 21 results in a high cost and inconvenient installation.

Further, there are two lamp head pressing elements 21 and two lamp seat pressing elements 31 which are arranged opposite to each other on the lamp head 20 and the lamp seat 30, respectively, so that the light-emitting plate 12 is uniformly stressed.

As shown in FIG. 7, the lamp seat 30 includes an end plate 343 and an annular side wall 345 extending along the edge of the end plate 343. The end plate 343 and the annular side wall 345 enclose a receiving groove 344 that is opened toward the light-emitting tube body 10. The end plate is provided with a first positioning step 32 and a second positioning step 33 adjacent to the edge thereof, where the first positioning step 32 is engaged with the arc-shaped heat-dissipating protrusion 113, and the second positioning step 33 is engaged with the arc-shaped light-transmitting cover 13. The first positioning step 32 and the second positioning step 33 are engaged with the inner side of the annular side wall 345. In order to conform to the arc-shaped heat-dissipating protrusion 113 and the arc-shaped light-transmitting cover 13, the first positioning step 32 and the second positioning step 33 are also arc-shaped.

In one embodiment, as shown in FIG. 9, the lamp head 20 is provided with a positioning rib 22 disposed on the side of the lamp head 20 facing the light-emitting tube body 10. The heat-dissipating protrusion 113 is inserted to the positioning rib 22 for positioning the heat-dissipating member 11 during the installation. The positioning rib 22 can be, for example, a plastic member. The positioning rib 22 provides a pre-installation position and facilitates a more convenient docking with the heat-dissipating member 11 for a convenient installation.

Further, as shown in FIG. 2, a power box 40 is disposed inside the heat-dissipating member 11, and a driving power 41 is installed inside the power box 40, so that the driving power 41 can drive the pluggable lamp 100 to emit light.

The present disclosure further provides another lamp seat. As shown in FIGS. 10-13, the lamp seat 30 includes a lamp seat end cap 34 and an outer lamp seat cover 35 connected to the lamp seat end cap 34. A dimmer switch 36 is provided on the side of the lamp seat end cap 34 facing the light-emitting tube body 10. Specifically, the dimmer switch 36 is electrically connected to the light-emitting tube body 10 so that the light color of the light-emitting tube body can be adjusted by controlling the dimmer switch 36.

Figure 13:
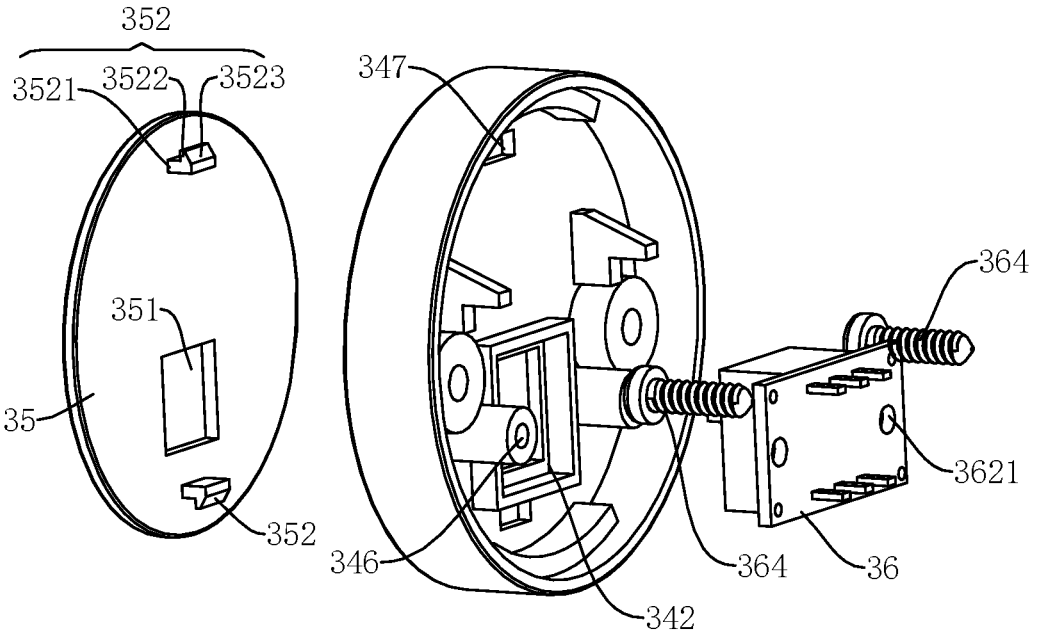
FIG. 13 is a schematic view of FIG. 12 from an opposite view.

As shown in FIG. 13, the dimmer switch 36 is provided with a first mounting hole 3621, and the lamp seat end cap 34 is provided with a second mounting hole 346 corresponding to the first mounting hole 3621. The dimmer switch 36 is mounted on the lamp seat end cap 34 by a connector 364 passing through the first mounting hole 3621 and the second mounting hole 346. The connector 364 can be a screw. It will be appreciated that the mounting seat of the dimmer switch can be mounted to the lamp seat end cap 34 by means of other means, such as snapping.

As shown in FIG. 13, the outer lamp seat cover 35 is provided with hooks 352 at the side facing the lamp seat end cap 34 for connecting with the lamp seat end cap 34, and first mounting openings 347 are defined in the lamp seat end cap 34 corresponding to the hooks 352 for mounting the hooks 352.

The lamp seat end cap 34 and the outer lamp seat cover 35 are connected by the hooks 352. When it is intended to attach the dimmer switch 36 to the lamp seat end cap 34 through the first mounting hole 3621, the second mounting hole 346, and the connector 364, or remove the dimmer switch 36 from the lamp seat end cap 34, only the outer lamp seat cover 35 needs to be removed, with simple and convenient operation. Further, the outer lamp seat cover 35 can also serve to shield and protect the internal components, with a concise outlook.

Specifically, the hook 352 includes a hook body 3521 and a hook head 3522 connected with each other. The hook body 3521 is connected to the outer lamp seat cover 35 and configured as an elastic member so that the hook head 3522 can be inserted into the first mounting opening 347 easily. The hook body 3521 extends from one end face of the outer lamp seat cover 35 towards the lamp seat end cap 34.

Further, the hook head 3522 is provided with a guide slope 3523 for guiding the hook 352 into the first mounting opening 347. When the hook head 3522 is inserted into the first mounting opening 347, the guide slope 3523 contacts the first mounting opening 347, and the hook body 3521 is deformed until the hook head 3522 is engaged with the first mounting opening 347.

For a stable connection between the lamp seat end cap 34 and the outer lamp seat cover the number of hooks 352 is at least two, and the hooks 352 are distributed in the circumferential direction of the outer lamp seat cover 35. The hook 352 is spaced from the edge of the outer lamp seat cover 35 by a distance, corresponding to the position of the first mounting opening 347.

Figure 14:
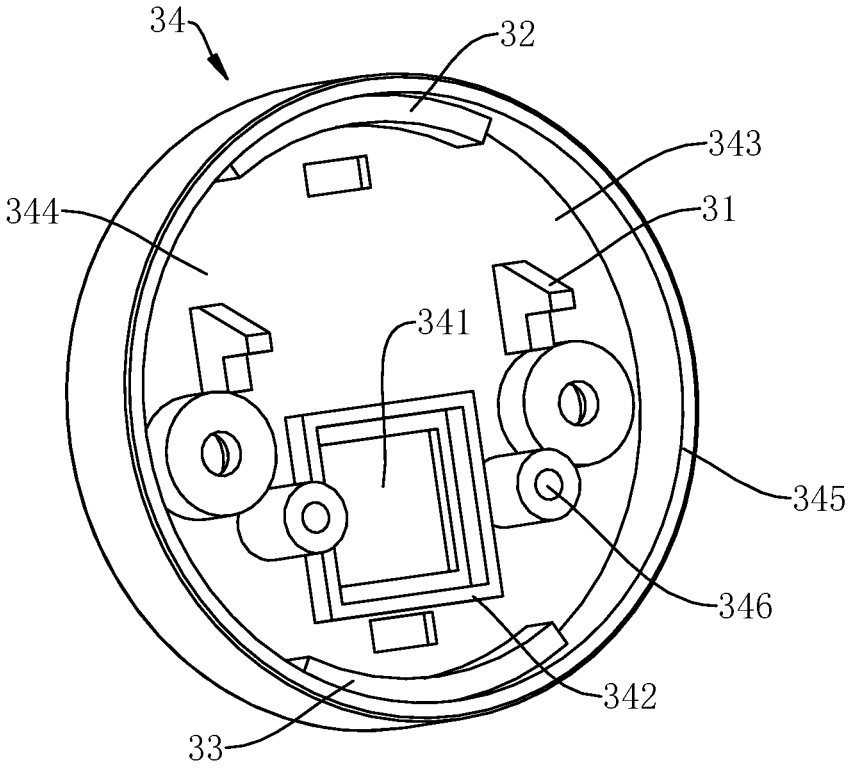
FIG. 14 is a schematic view of a lamp seat end cap of FIG. 10.
Figure 15:
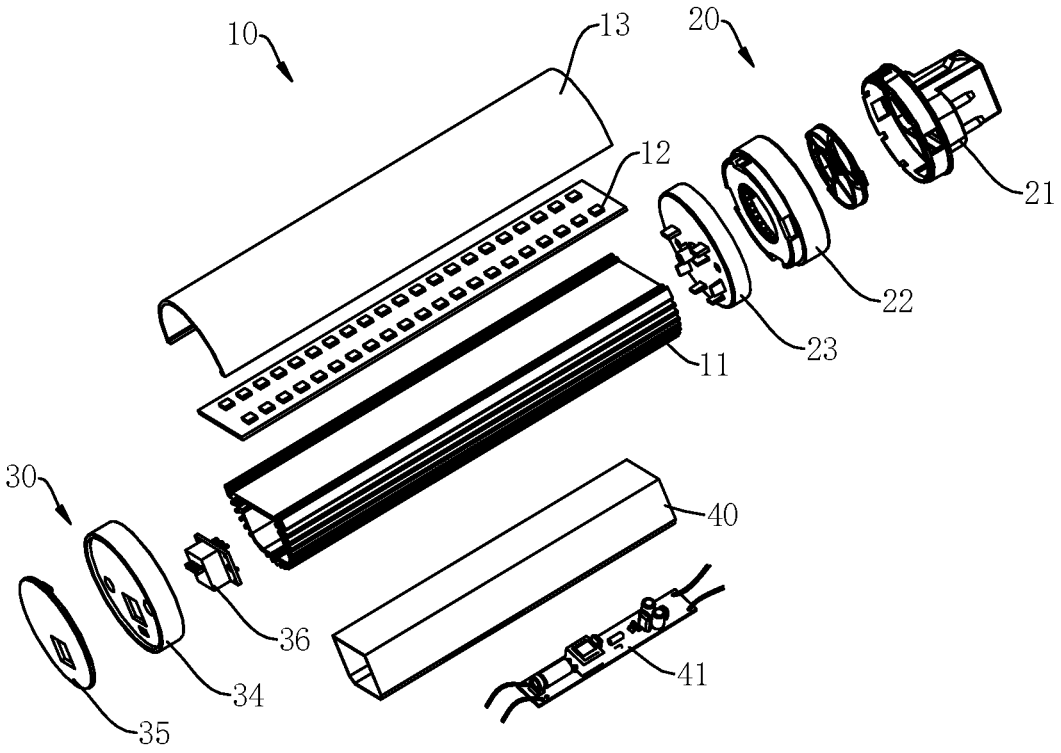
FIG. 15 is an exploded schematic view of a pluggable lamp according to a further embodiment of the present disclosure.

As shown in FIG. 14, the lamp seat end cap 34 includes an end plate 343 and an annular side wall 345 distributed along the edge of the end plate 343. The end plate and the annular side wall 345 enclose a receiving groove 344 which is opened towards the light-emitting tube body. The first mounting opening 347 is located in the end plate 343. In one embodiment, the number of the hooks 352 is two, and the two hooks 352 are arranged in a center symmetrical manner, so that the lamp seat end cap 34 and the outer lamp seat cover 35 can be engaged with each other under a uniform force.

Figure 12:
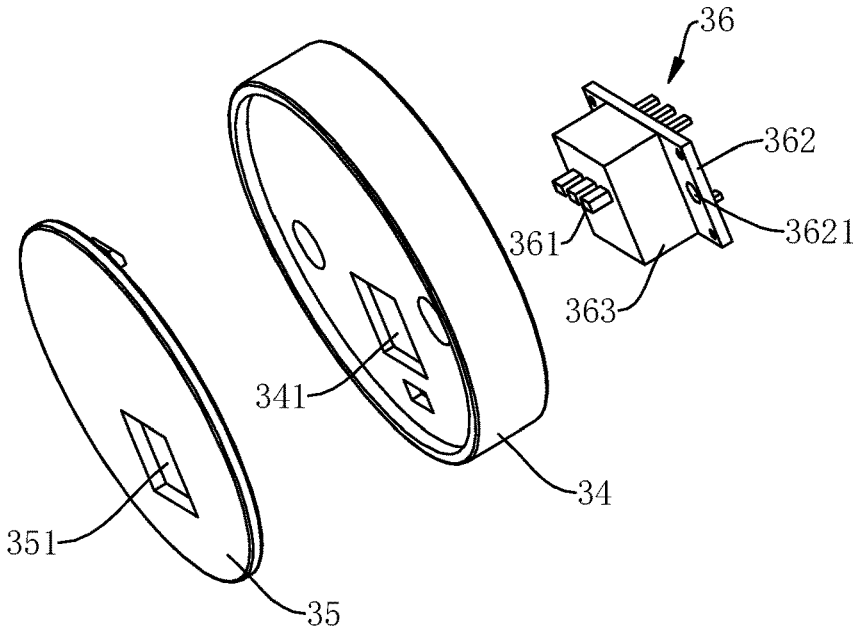
FIG. 12 is an exploded view of the lamp seat of FIG. 11.

In one embodiment, as shown in FIG. 12, the dimmer switch 36 is provided with dimmer buttons 361, and the dimmer switch 36 is operated through the dimmer buttons 361 to adjust the light color of the light-emitting tube body 10.

Specifically, as shown in FIGS. 12 and 13, a first window 341 is defined in the lamp seat end cap 34, a second window 351 is defined in the outer lamp seat cover 35, and the second window 351 corresponds to the first window 341 of the lamp seat end cap 34. The dimmer buttons 361 are exposed within the first window 341 and the second window 351. Specifically, the shapes of the first window 341 and the second window 351 can be set as needed, and the sizes of the first window 341 and the second window 351 should be large enough to expose the dimmer buttons. It will be appreciated that, by providing the dimmer switch 36 at the lamp seat 30 and exposing the dimmer buttons 361 in the first window 341 and the second window 351, the user can operate conveniently and control the dimmer switch 36 by operating the dimmer buttons 361 to adjust the light color and select various light colors.

Further, as shown in FIGS. 13 and 14, the lamp seat end cap 34 is provided with an outer frame 342 surrounding the first window 341 and located on the side of the lamp seat end cap 34 facing the light-emitting tube body 10. The dimmer switch 36 is disposed at least partially within the outer frame 342 and abutted against the lamp seat end cap 34, and the outer frame 342 is configured to receive and limit the dimmer switch 36, wherein "at least partially" means that part or the entire of the dimmer switch 36 is disposed within the outer frame 342. The outer frame 342 is shaped to fit the dimmer switch 36. The outer frame 342 is provided to facilitate the mounting of the dimmer switch 36.

More specifically, the outer frame 342 is square, and the corresponding first window 341 and the second window 351 are also square, which simplifies the processing process.

Figure 11:
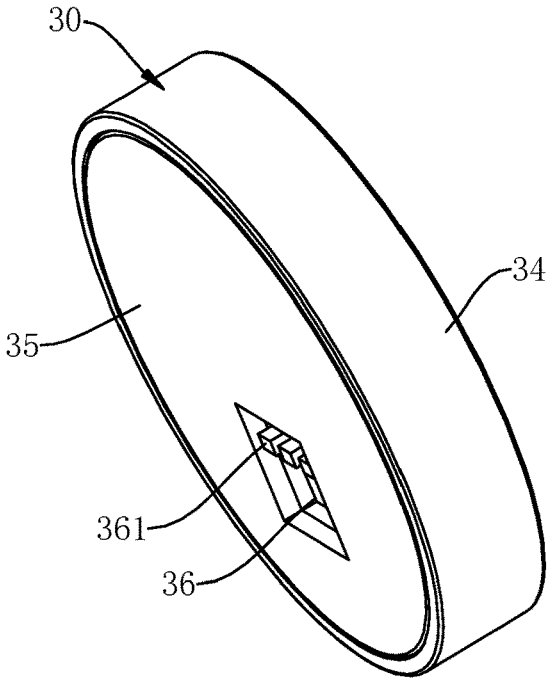
FIG. 11 is a schematic view of a lamp seat of FIG. 10.

In one embodiment, referring to FIG. 11, the dimmer buttons 361 do not exceed the top side of the outer lamp seat cover 35 to prevent the dimmer buttons 361 from extending out of the outer lamp seat cover 35 and being easily damaged or abraded, so as to protect the dimmer buttons 361. It will be appreciated that the top side is the side away from the lamp seat end cap 34.

Specifically, as shown in FIG. 12, the dimmer switch 36 includes a mounting seat 362 for connecting with the lamp seat end cap 34, and a dimmer switch body 363 for connecting with the dimmer buttons 361. The dimmer buttons 361 are disposed on the dimmer switch body 363, the dimmer switch body 363 is disposed on the mounting seat 362, and the mounting seat 362 is connected with the lamp seat end cap 34 through a connector. As the outer frame 342 has a square shape, the dimmer switch body 363 has a square shape, too.

Further, the dimmer switch body 363 is disposed in the outer frame 342 and abuts against the lamp seat end cap 34. The dimmer switch body 363 is limited by the circumferential limitation of the outer frame 342 and the axial limitation of the lamp seat end cap 34, facilitating the mounting of the dimmer switch 36 to the lamp seat end cap 34.

More specifically, the height of the outer frame 342 is ½ to ¼ of the height of the dimmer switch body 363. A too high height of the outer frame 342 is detrimental to the compactness of the assembly and also increases the cost. A too low height of the outer frame 342 is detrimental to the limitation on the dimmer switch body 363. Preferably, the height of the outer frame 342 is ⅓ of the height of the dimmer switch body 363.

As shown in FIGS. 15-20, the disclosure further discloses another lamp head 20 including a lamp head body 21, a lamp head end cap 22 and a lamp fixing plate 23 connected in sequence, wherein the lamp fixing plate 23 is fixed to the light-emitting tube body 10. The lamp head body 21, the lamp head end cap 22 and the lamp fixing plate 23 are arranged in order as shown in FIG. 4, where the lamp head end cap 22 is connected between the lamp fixing plate 23 and the lamp head body 21.

Figure 18:
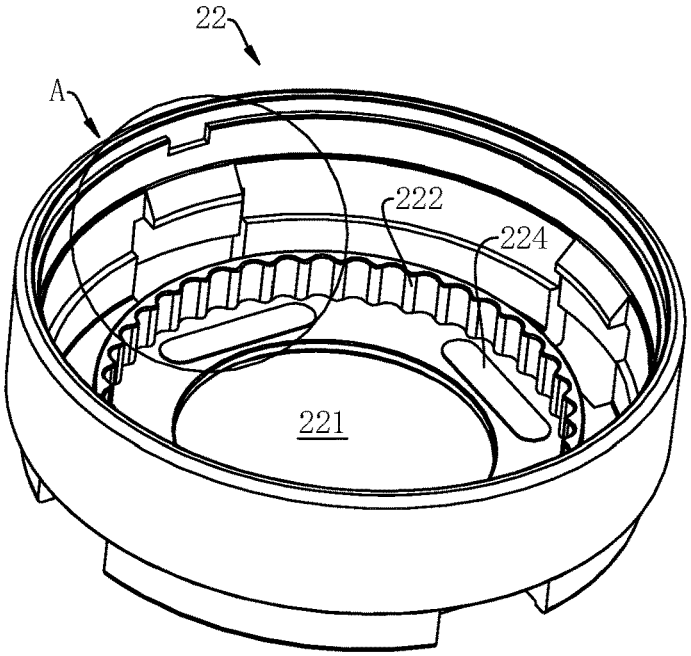
FIG. 18 is a schematic view of a lamp head end cap of FIG. 16.

As shown in FIG. 18, a mounting window 221 is defined in the top side wall of the lamp head end cap 22, wherein the top side is the side adjacent the lamp fixing plate 23. An internal gear ring 222 is disposed around the mounting window 221 of the lamp head 20 and inside the lamp head end cap 22. The internal gear ring 222 is provided with a rotation plate 24 rotatably connected with the internal gear ring 222. The lamp fixing plate 23 is provided with a connector passing through the mounting window 221 and connected with the rotation plate 24. The rotation plate 24 rotates along the internal gear ring 222 under the driving of the lamp fixing plate 23.

It can be understood that the rotation plate 24 is installed within the lamp head end cap 22 and cooperates with the internal gear ring 222, and is connected with the lamp fixing plate 23 through the connector so as to move synchronously along with the lamp fixing plate 23. The connector can be, for example, a connecting rod, a connecting block or other connector. The light-emitting tube body 10 is fixedly connected to the lamp fixing plate 23, and the lamp head body 21 is fixedly connected to the lamp head cap 22. When the light-emitting tube body 10 rotates relative to the lamp head body 21, the lamp fixing plate 23 rotates relative to the lamp head end cap 22. Specifically, the lamp fixing plate 23 drives the rotation plate 24 to rotate relative to the internal gear ring 222 in the lamp head end cap 22.

In the present disclosure, the light-emitting direction of the pluggable lamp 100 can be adjusted by rotating the lamp head 20. As the rotation plate 24 cooperates with the internal gear ring 222, the lamp head 20 can be assembled conveniently, and it is more convenient to determine the gear selection when rotating the pluggable lamp 100, with a better hand feeling.

Figure 16:
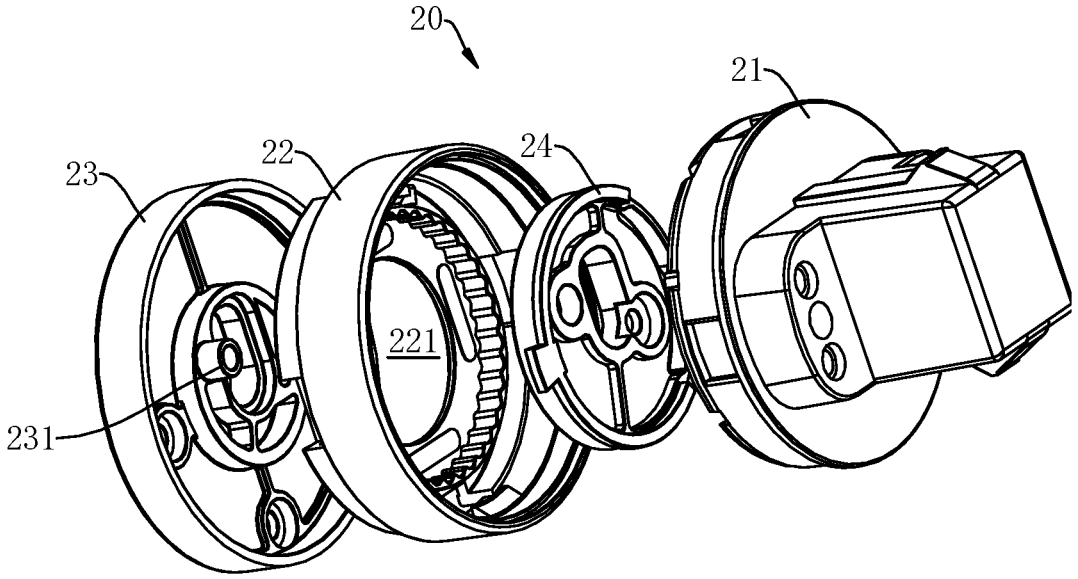
FIG. 16 is an exploded structural view of a lamp head of FIG. 15.
Figure 17:
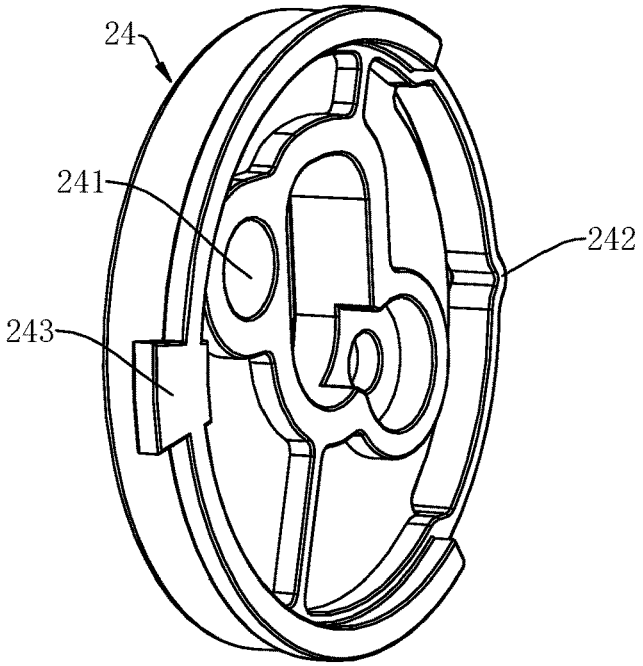
FIG. 17 is a schematic view of a rotation plate of FIG. 16.

In one embodiment, as shown in FIGS. 16 and 17, for the synchronous movement of the rotation plate 24 and the lamp fixing plate 23, a mounting hole 241 is defined in the rotation plate 24, and a connecting rod 231 extending from the lamp fixing plate 23 toward the rotation plate 24 is provided on the lamp fixing plate 23. The connecting rod 231 is engaged with the mounting hole 241. During installation, the connecting rod 231 is inserted into the mounting hole 241 through the mounting window 221 so as to connect the lamp fixing plate 23 and the rotation plate 24. In one embodiment, the connecting rod 231 can be, for example, cylindrical, as the cylindrical connecting rod 231 can be inserted into the mounting hole 241 conveniently.

Specifically, as shown in FIG. 17, the rotation plate 24 includes a positioning tooth 242 that meshed with the internal gear ring 222. In engagement, the positioning tooth 242 cooperates with the internal gear ring 222. Upon rotation, the positioning tooth 242 is disengaged from the original location on the internal gear ring 222 and moves to the next location. In one embodiment, the positioning tooth 242 is configured as a protrusion extending outwardly from the rotation plate 24.

Figure 20:
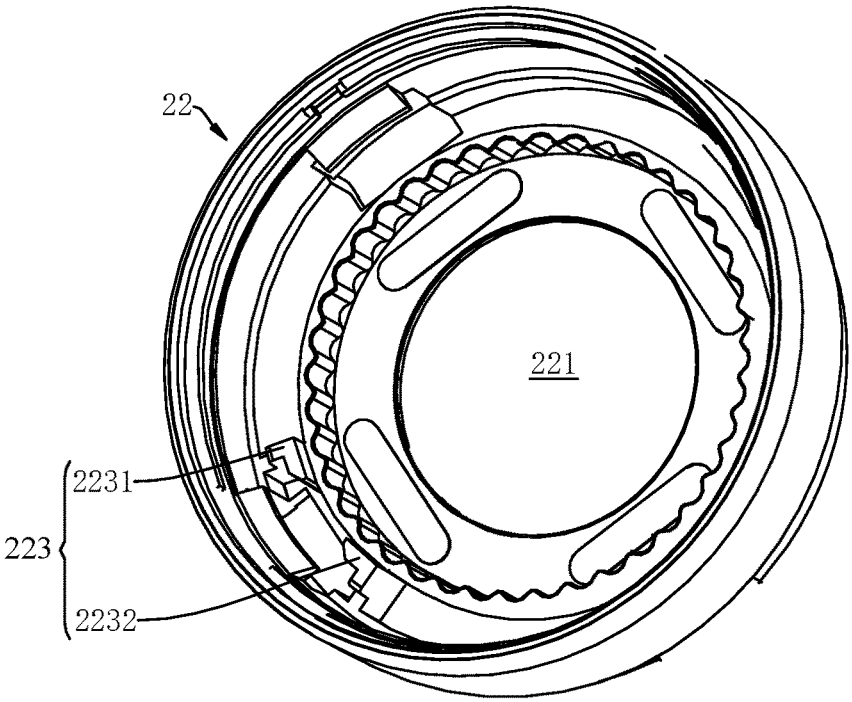
FIG. 20 is a schematic view of the lamp head end cap of FIG. 16 from another view.
Figure 21:
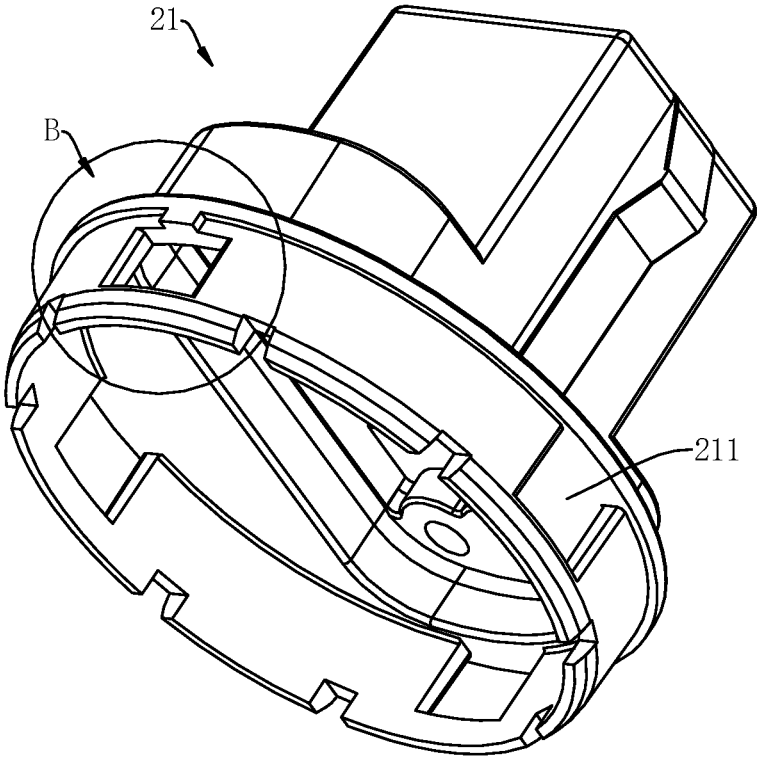
FIG. 21 is a schematic view of the lamp head of FIG. 16.

In one embodiment, as shown in FIGS. 17 and 20, to prevent free rotation of the rotation plate 24 within the lamp head end cap 22, leading to entanglement of electric wires of the pluggable lamp 100, the rotation plate 24 includes a limiting plate 243 extending in the radial direction, and at least one stopper 223 is provided on the sidewall of the lamp head end cap 22. During rotation of the rotation plate 24 under an external force, the limiting plate 243 would not continue to rotate in the same direction when encountering the stopper 223 of the lamp head end cap 22, which means that the rotation plate 24 cannot rotate in the direction anymore and can only rotate in the opposite direction, thereby preventing entanglement of electric wires. It will be appreciated that the range of movement of the rotation plate 24 within the internal gear ring 222 can be set by arranging the stopper 223.

Specifically, the stopper 223 includes a first block 2231 and a second block 2232 disposed on the sidewall of the lamp head end cap 22, and the distance between the first block 2231 and the second block 2232 in the circumferential direction of the lamp head end cap 22 is 0.2 to 0.3 of the circumference of the lamp head end cap 22. It can be understood that in the circumferential direction of the lamp head end cap 22, the spacing between the first block 2231 and the second block 2232 refers to the non-movable area for the limiting plate 243, while the opposite spacing between the first block 2231 and the second block 2232 refers to the movable area for the limiting plate 243, which corresponds to the area where the light-emitting tube body can rotate. By setting the distance between the first block 2231 and the second block 2232 (two stoppers), the rotation range of the rotation plate 24 can be controlled. The distance between the first block 2231 and the second block 2232 representing the non-movable area should not be too large, for example, can be 0.2 of the circumference of the lamp head end cap 22.

Further, as shown in FIG. 18, at least one plastic protrusion 224 is disposed on an inner side of the lamp head end cap 22 facing the rotation plate 24, and the plastic protrusion 224 abuts against the rotation plate 24. The plastic protrusion 224 reduces the contact area between the rotation plate 24 and the lamp head end cap 22, thereby reducing the frictional resistance between the lamp head end cap 22 and the rotation plate 24, with a smoother rotation.

More specifically, there are four plastic projections 224, which are sequentially arranged along the circumference of the lamp head end cap 22. It is to be understood that there can be three or five plastic projections 224, the contact surfaces of which are kept in the same circumferential direction, thereby providing a more uniform force.

Figure 19:
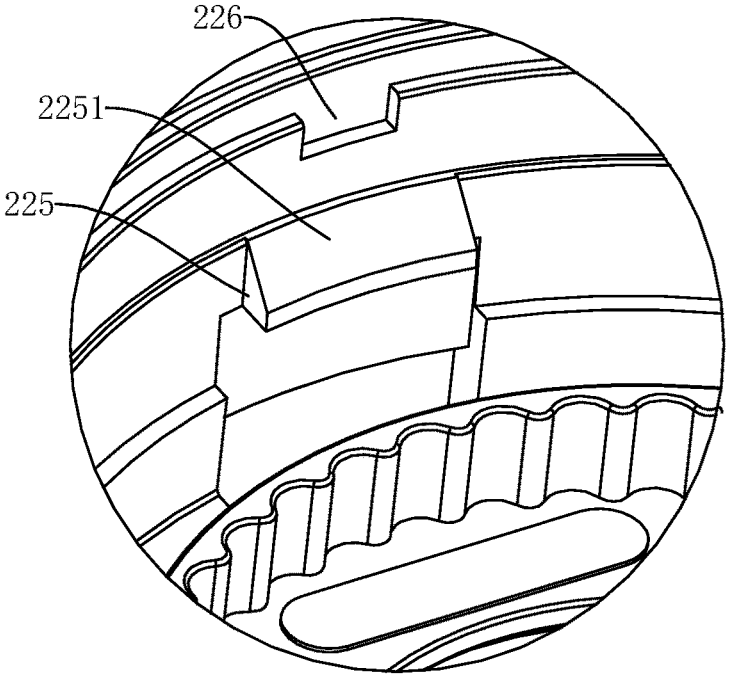
FIG. 19 is an enlarged view of part A of FIG. 18.
Figure 22:
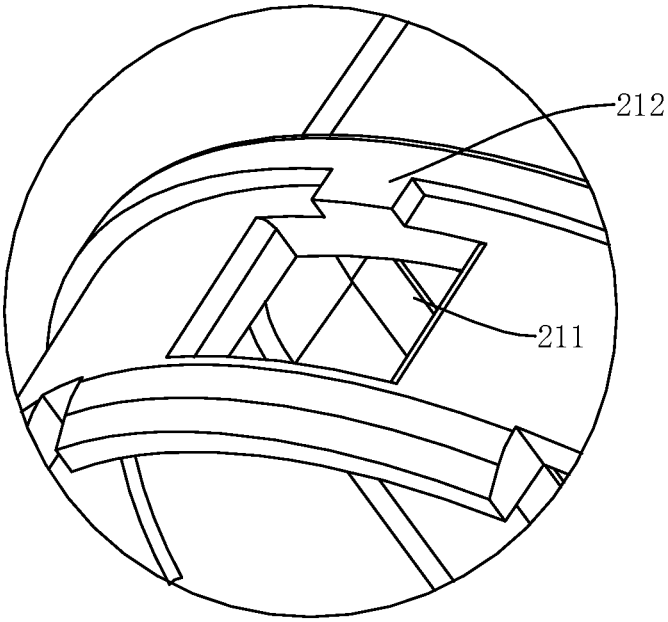
FIG. 22 is an enlarged view of part B of FIG. 21.

In one embodiment, as shown in FIGS. 19 and 22, at least one second mounting opening 211 is defined in the side wall of the lamp head body 21, and at least one elastic hook 225 is provided on an inner side wall of the lamp head end cap 22. The elastic hook 225 extends into the second mounting opening 211 to connect the lamp head body 21 and the lamp head end cap 22. It can be understood that the second mounting openings 211 are evenly arranged along the circumferential direction of the lamp head body 21. For example, four second mounting opening 211 can be provided, and accordingly, four elastic hooks 225 are provided. When the lamp head body 21 and the lamp head end cap 22 are connected with each other, the elastic hooks 225 are inserted into the respective second mounting openings 211, thereby completing the installation, with the rotation plate 24 provided between the lamp head body 21 and the lamp head end cap 22.

Further, as shown in FIG. 19, the elastic hook 225 is provided with a guide slope 2251 for guiding the elastic hook 225 into the second mounting opening 211. The elastic hook 225 has a certain length along the circumferential direction of the lamp head end cap 22, so as to increase the contact area with the second mounting opening 211, thereby enhancing the installation stability.

In another embodiment, as shown in FIGS. 19 and 22, one of the second mounting openings 211 is provided with a positioning protrusion 212, and one of the elastic hooks 225 is provided with a positioning groove 226 that is engaged with the positioning protrusion 212. It can be understood that the positioning protrusion 212 is provided on the lamp head body 21 and adjacent to the second mounting opening 211, and the positioning groove 226 is defined in the lamp head end cap 22, such that when the positioning protrusion 212 and the positioning groove 226 are aligned with each other, the elastic hooks 225 are also aligned with the respective second mounting openings 211. The engagement of the positioning protrusion 212 with the positioning groove 226 provides an axial positioning, and also allows the lamp head body 21 and the lamp head end cap 22 to be assembled at an only designated position, rather than at any positions. Further, the components of the lamp head 20 can be installed in the same direction, providing a convenient assembly.

Further, a limiting step is disposed on an inner side surface of the lamp head end cap 22, and the limiting step abuts and limits the lamp head body 21 extending into the lamp head end cap 22.

The above embodiments only represent several embodiments of the present invention, and the description thereof is specific and detail, but should not be construed as limiting the scope of the invention. It should be noted that, for those of ordinary skill in the art, several modifications and improvements can be made without departing from the concept of the present invention, all of which fall into the protection scope of the present invention. Therefore, the scope of protection of this invention should be subject to the appended claims.

What is claimed is:

1. A pluggable lamp, comprising a light-emitting tube body, and a lamp head and a lamp seat respectively provided at two ends of the light-emitting tube body;

the light-emitting tube body comprising a heat-dissipating member, and a light-emitting plate and a light-transmitting cover provided on the heat-dissipating member, and a first mounting groove for mounting the light-emitting plate is opened on one side of the heat-dissipating member;

the light-emitting plate having opposite top and bottom sides, with the bottom side overlapped against a groove bottom of the first mounting groove, wherein one side of the light-emitting plate adjacent the lamp head is defined as a first end, and the other side of the light-emitting plate adjacent the lamp seat is defined as a second end;

at least one lamp head pressing element being provided on one side of the lamp head facing the light-emitting tube body;

at least one lamp seat pressing element being provided on one side of the lamp seat facing the light-emitting tube body; and wherein the lamp head pressing element and the lamp seat pressing element abut against the top side at the first end and the top side at the second end, respectively, so as to fix the light-emitting plate within the first mounting groove; and wherein the lamp seat comprises a lamp seat end cap and an outer lamp seat cover connected with the lamp seat end cap, and one side of the lamp seat end cap facing the light-emitting tube body is connected with a dimmer switch which is electrically connected to the light-emitting tube body to adjust light colors thereof.

2. The pluggable lamp according to claim 1, wherein the heat-dissipating member is tubular, and comprises a top plate provided with the first mounting groove and a heat-dissipating protrusion opposite to the first mounting groove, and wherein the heat-dissipating protrusion has a U-shaped cross section.

3. The pluggable lamp according to claim 2, wherein the lamp head is provided with a positioning rib at one side facing the light-emitting tube body and inserted into the heat-dissipating protrusion.

4. The pluggable lamp according to claim 2, wherein a power box is arranged inside the heat-dissipating member, and a driving power is arranged inside the power box.

5. The pluggable lamp according to claim 2, wherein the lamp seat comprises an end plate and an annular side wall distributed along an edge of the end plate, with the end plate and the annular side wall enclosed a receiving groove opened toward the light-emitting tube body, and the end plate is provided with a first positioning step and a second positioning step adjacent to the edge of the end plate, and the first positioning step and the second positioning step are respectively engaged with the heat-dissipating protrusion of the heat-dissipating member and the light-transmitting cover.

6. The pluggable lamp according to claim 5, wherein the first positioning step and the second positioning step have heights smaller than a depth of the receiving groove along a length direction of the light-emitting tube body.

7. The pluggable lamp according to claim 1, wherein a first window is opened in the lamp seat end cap, and a second window is opened in the outer lamp seat cover at a position corresponding to the first window of the lamp seat end cap, and wherein the dimmer switch is provided with a dimmer button which is exposed within the first window and the second window.

8. The pluggable lamp according to claim 7, wherein the lamp seat end cap is provided with an outer frame surrounding the first window at one side facing the light-emitting tube body, and the dimmer switch is at least partially disposed within the outer frame and against the lamp seat end cap.

9. The pluggable lamp according to claim 1, wherein the dimmer switch is provided with a first mounting hole, and the lamp seat end cap is provided with a second mounting hole at a position corresponding to the first mounting hole, and wherein the dimmer switch is arranged on the lamp seat end cap by a connector passing through the first mounting hole and the second mounting hole.

10. The pluggable lamp according to claim 1, wherein the outer lamp seat cover is provided with a hook for connecting with the lamp seat end cap at one side facing the lamp seat end cap, and the lamp seat end cap is provided with a mounting opening at a position corresponding to the hook for mounting the hook.

11. The pluggable lamp according to claim 10, wherein the hook comprises a hook body and a hook head connected with each other, and the hook body is connected to the outer lamp seat cover and configured as an elastic member.

12. The pluggable lamp according to claim 1, wherein the lamp head comprises a lamp head body, a lamp head end cap and a lamp fixing plate connected in sequence, and the lamp fixing plate is fixedly connected with the light-emitting tube body; and a mounting window is opened in a top side wall of the lamp head end cap, an internal gear ring is arranged in the lamp head end cap and surrounding the mounting window of the lamp head, and a rotation plate is arranged on the internal gear ring, wherein the rotation plate is rotatably connected with the internal gear ring, the lamp fixing plate is provided with a connector which is connected with the rotation plate through the mounting window, and the rotation plate is configured to be driven by the lamp fixing plate so as to rotate along the internal gear ring.

13. The pluggable lamp according to claim 12, wherein the connector is configured as a connecting rod extending from the lamp fixing plate to the rotation plate, the rotation plate is provided with a mounting hole, and the connecting rod is inserted into the mounting hole through the mounting window to connect the lamp fixing plate and the rotation plate.

14. The pluggable lamp according to claim 12, wherein the rotation plate comprises a positioning tooth meshing with the internal gear ring.

15. The pluggable lamp according to claim 12, wherein the rotation plate comprises a limiting plate extending in a radial direction, and at least one stopper is arranged on a sidewall of the lamp head end cap.

16. The pluggable lamp according to claim 12, wherein at least one second mounting opening is opened on a side wall of the lamp head body, and at least one elastic hook is arranged on an inner side wall of the lamp head end cap, and wherein the elastic hook extends into the second mounting opening to connect the lamp head body and the lamp head end cap.

17. The pluggable lamp according to claim 16, wherein one of the at least one second mounting opening is provided with a positioning protrusion, and one of the at least one elastic hook is provided with a positioning groove matching with the positioning protrusion.

18. The pluggable lamp according to claim 1, wherein the heat-dissipating member is provided with second mounting grooves respectively located at two sides of the first mounting groove, with a positioning flange provided on an inner wall of the second mounting groove, and the light-transmitting cover is provided with two hooked edges circumferentially opposite to each other, and the hooked edges respectively extend into the respective second mounting grooves and abut against the respective positioning flanges through elastic force.

19. The pluggable lamp according to claim 18, wherein the hooked edge extends axially and comprises an inward extension portion and an outward extension portion, with a positioning portion bent between the inward extension portion and the outward extension portion and engaged with the positioning flange.

* * * * *